US005820349A

United States Patent [19]

Caillat

[11] Patent Number: 5,820,349

[45] Date of Patent: Oct. 13, 1998

[54] ROTARY COMPRESSOR WITH REVERSE ROTATING BRAKING

[75] Inventor: Jean-Luc Caillat, Dayton, Ohio

[73] Assignee: Copeland Corporation, Sidney, Ohio

[21] Appl. No.: 910,296

[22] Filed: Aug. 13, 1997

Related U.S. Application Data

[63] Continuation of Ser. No. 528,405, Sep. 14, 1995, abandoned.

[51] Int. Cl.[6] ..... F04B 49/06

[52] U.S. Cl. ..... 417/44.11; 417/53

[58] Field of Search ..... 417/44.11, 53, 417/326, 411, 423.7; 418/55.1, 55.6; 318/432, 434, 374; 310/74

[56] References Cited

U.S. PATENT DOCUMENTS

| | | | |
|---|---|---|---|
| 4,767,293 | 8/1988 | Caillat et al. . | |
| 4,955,795 | 9/1990 | Griffith . | |
| 4,998,864 | 3/1991 | Muir . | |
| 5,006,045 | 4/1991 | Shimoda et al. | 417/42 |
| 5,075,610 | 12/1991 | Harris | 318/701 |
| 5,102,316 | 4/1992 | Caillat et al. . | |
| 5,156,539 | 10/1992 | Anderson et al. . | |
| 5,220,259 | 6/1993 | Werner et al. | 318/432 |
| 5,246,349 | 9/1993 | Hartog | 417/371 |
| 5,320,507 | 6/1994 | Monnier et al. | 418/55.6 |
| 5,432,420 | 7/1995 | Bahn | 318/701 |
| 5,489,831 | 2/1996 | Harris | 318/701 |
| 5,518,373 | 5/1996 | Takagi et al. | 417/45 |

*Primary Examiner*—Jack B. Harvey
*Assistant Examiner*—Xuan M. Thai
*Attorney, Agent, or Firm*—Harness, Dickey & Pierce, P.L.C.

[57] ABSTRACT

An electrical motor driven rotary compressor having electrical components for preventing reverse rotation of the motor-compressor upon deenergization of the motor. The rotary compressor determines if a change in condition has occurred which could result in reverse rotation of the motor-compressor and energizes a motor stator circuit in response to the determined change in condition so as to apply a braking torque to oppose reverse rotation of the motor-compressor.

29 Claims, 5 Drawing Sheets

| Speed Setpoint | Speed Signal | Setpoint Less Speed Signal ($\Delta S$) | Controller Decision |
|---|---|---|---|
| > 0 | > 0 | > 0 | Increase–Speed Signal (Adjust On–Off Timing Of Switches) |
| > 0 | > 0 | = 0 | No– Speed–Change Signal |
| > 0 | > 0 | < 0 | Decrease–Speed Signal (Adjust On–Off Timing Of Switches) |
| = 0 | > 0 | < 0 | All–Switches–Open Signal – (Coasting) |
| = 0 | = 0 | = 0 | All–Switches–Open Signal – (Stopped) |
| = 0 | < 0 | > 0 | Braking Signal – (Apply Brake Timing) |

FIG. 5.

ROTARY COMPRESSOR WITH REVERSE ROTATING BRAKING

This is a continuation of U.S. patent application Ser. No. 08/528,405, filed Sep. 14, 1995, entitled ROTARY COMPRESSOR WITH REVERSE ROTATION BRAKING, naming as inventor Jean-Luc Caillat, which has been expressly abandoned.

FIELD OF THE INVENTION

The present invention relates generally to motor driven compressors, and more particularly to an apparatus and method for reverse rotation braking of rotary compressors, such as scroll compressors and screw compressors, which often are driven in the reverse direction by system pressure upon deenergization.

BACKGROUND AND SUMMARY OF THE INVENTION

Rotary compressors such as those of the scroll type and screw type are known rotary machines that are commonly used for compressing gaseous fluids. These types of compressors do not require and therefore are often manufactured without provision for a check valve at the discharge side of the compression chambers. Consequently, upon deenergization of the compressor motor the high pressure gaseous fluid at the discharge side tends to drive the compressor in the reverse direction. Also, these types of compressors feature generally volumes of gas at various stages of compression. Therefore, even though a valve may be present at the discharge side of these compression chambers, preventing high pressure gas to flow back in there volumes, there is enough energy left in the compression volume to cause reverse rotation upon de-engergization of the compressor motor. In any case, this results in a reverse rotation of the scroll members which in turn directly causes the drive shaft and driving motor to also rotate in the reverse direction. Reverse rotation of the compressor components at excessive speeds may produce undesirable noise and component distress, especially with compressors which can exhibit large instantaneous reverse rotation speeds without any braking system due to high pressure shutdown conditions. In the marketplace, there is an increasing demand for quieter machinery, especially in air conditioning and heat pump systems.

It is therefor a primary object of the present invention to provide a rotary compressor which effectively and efficiently reduces high speed reverse rotation of the compressor components by electrically braking the motor to oppose rotation in the reverse direction. This is accomplished in the present embodiment by equipping the compressor with a switched reluctance motor and special circuitry which generates a braking torque to oppose this reverse rotation by applying energy to stator circuits in the motor. It is a further object of the present invention to recover energy back through the motor and efficiently use such energy to effect the braking torque.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 6 is a logic table illustrating controller decisions for controlling the compressor of the present invention.

DETAILED DESCRIPTION OF THE PREFERRED EMBODIMENT

Figure 1:
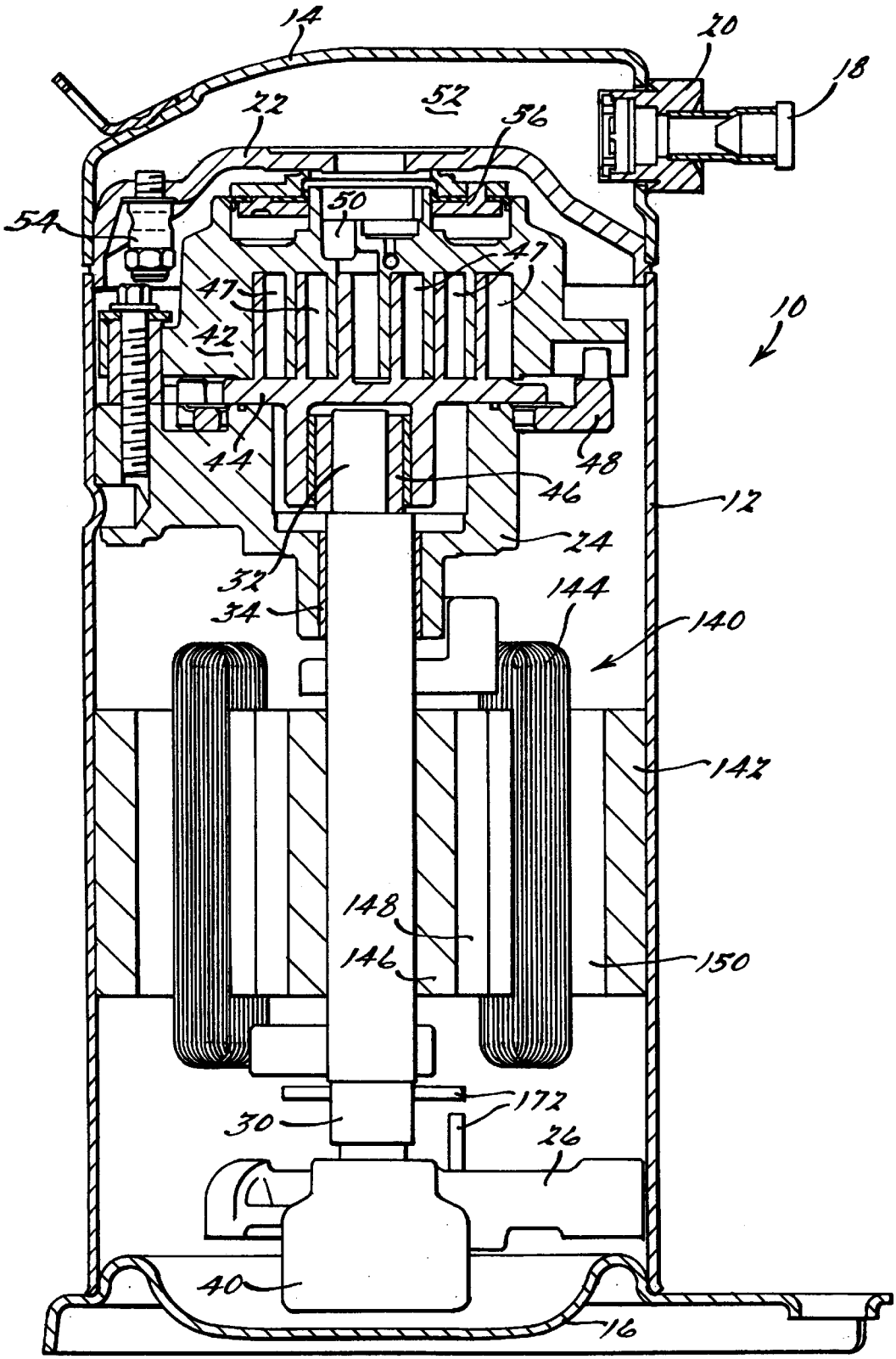
FIG. 1 is a diagrammatic vertical sectional view through the center of a scroll type compressor equipped with a switched reluctance motor, according to the present invention.

While the present invention is suitable for incorporation in a number of different types of rotary compressors, for exemplary purposes it will be described herein incorporated in a scroll compressor for compressing gaseous refrigerant and being of the general structure illustrated in FIG. 1. Generally speaking, the compressor 10 comprises a substantially cylindrical hermetic shell 12 having welded at the upper end thereof a cap 14 and at the lower end thereof a base 16 which includes a plurality of mounting feet (partially shown) integrally formed therewith. Cap 14 is provided with a refrigerant discharge valve assembly 20 including a discharge fitting 18 which may have the usual discharge valve therein. Other major elements affixed to the shell include a transversely extending muffler plate 22 which is welded about its periphery at the same point that cap 14 is welded to shell 12, a main bearing housing 24 which is suitably secured to shell 12 and a lower bearing housing 26 having a plurality of radially outwardly extending legs each of which is suitably secured to shell 12.

A drive shaft or crankshaft 30 having an eccentric crank pin 32 at the upper end thereof is rotatably journaled in a bearing 34 in a main bearing housing 24. The lower end of crankshaft 30 is rotatably supported in a bearing assembly 40 supported by lower bearing housing 26.

The scroll mechanism itself generally comprises a non-orbiting scroll member 42, an orbiting scroll member 44 driven in an orbital path with respect to scroll member 42 by means of crank pin 32 via a drive bushing 46. Each of the scroll members have the usual spiral wraps which are intermeshed in the usual manner to create compression chambers 47 of progressively decreasing volume as the scroll members are orbited with respect to one another. An Oldham ring assembly 48 operates between the two scroll members to prevent relative rotation therebetween.

Inlet gas is delivered into shell 12 via an inlet gas fitting (not shown). The compression chambers 47 traps the inlet gas from an inlet zone in the shell which is at inlet pressure, compress it, and deliver compressed gas to a discharge zone at discharge pressure. This gas flows through a discharge port 50 and muffler plate 22 into a discharge muffler 52 defined by muffler plate 22 and cap 14. The compressed gas is discharged from muffler 52 through the valve assembly 20 and discharge fitting 18. A conventional IPR valve 54 is provided to relieve excessive pressures in muffler 52 and a floating seal 56 is provided for the purpose of providing pressurized axial sealing bias under normal operating conditions. For a full explanation of all of the components of the machine and the manner in which they work reference should be made to applicant's assignee's issued U.S. Pat. Nos. 4,767,293, 4,988,864, 5,102,316 and 5,156,539, the disclosures of which are hereby incorporated herein by reference.

Figure 2:
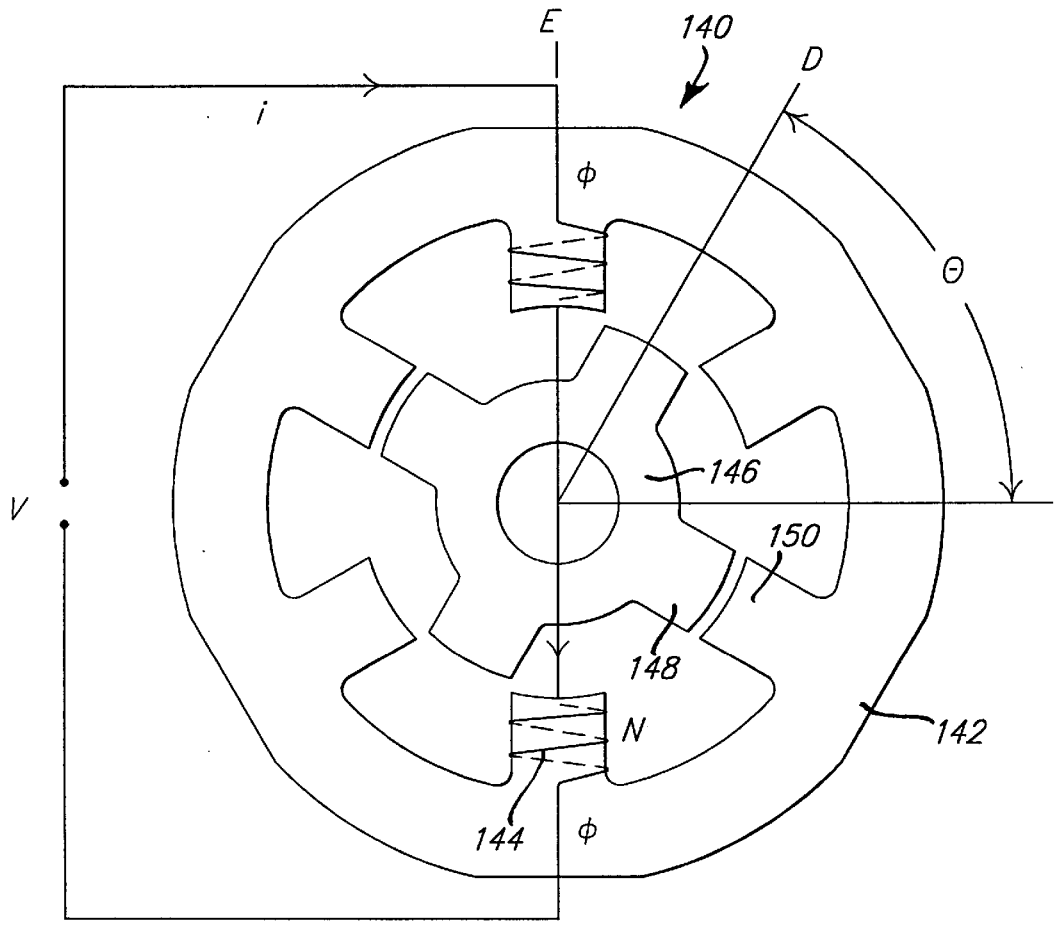
FIG. 2 is a schematic cross-section of the switched reluctance motor showing the application of energy to one phase thereof.

Crankshaft 30 is rotatively driven by an electric motor 140 preferably of the switched reluctance type having a rotor 146 and a stator 142 equipped with stator windings 144 as shown in FIGS. 1 and 2. The rotor 146 may be interference-fit on crankshaft 30, while the motor stator 142 may be interference-fit into shell 12. The rotor 146 is directly connected to the crankshaft 30 and has a plurality of salient members 148 which form one or more pairs of diametrically opposed rotor poles. The stator 142 is likewise configured with a plurality of salient members 150 which form one or more pairs of diametrically opposed stator poles each have N-turn stator windings 144. Each pair of opposed stator poles share common stator windings connected in series (as shown) or alternately in parallel for providing a single phase of the motor 140. The example shown in FIGS. 2 and 3 is a three-phase switched reluctance motor having six stator and four rotor poles. Motor 140 operates in the normal manner in response to a direct current (DC) applied to the stator windings 144 associated with a corresponding phase in a sequential manner so as to apply a magnetic field on the stator 142 which in turn creates magnetic forces between the stator 142 and rotor 146 that combine in the form of a torque thereby causing the rotor 146 to rotate and drive the crankshaft 30 of compressor 10.

Figure 3A:
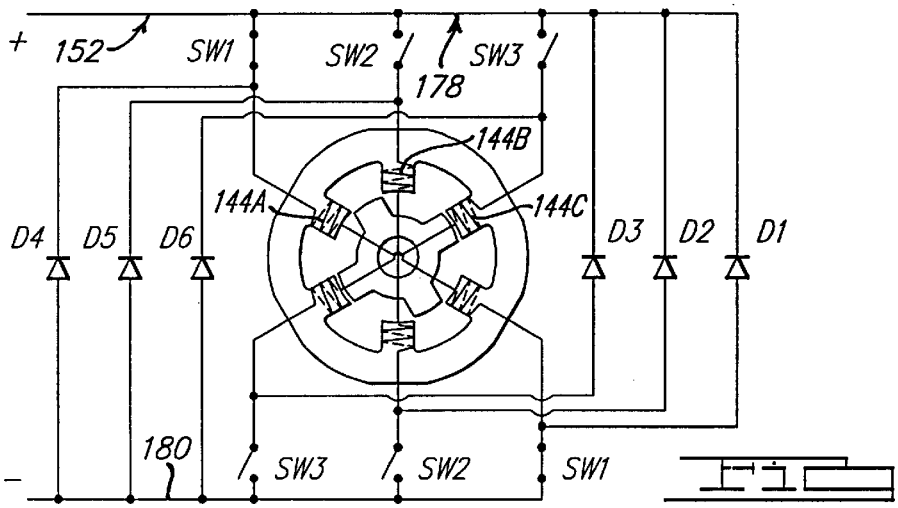
FIGS. 3A through 3C illustrate a sequence of motor control switching for the switched reluctance motor.
Figure 3B:
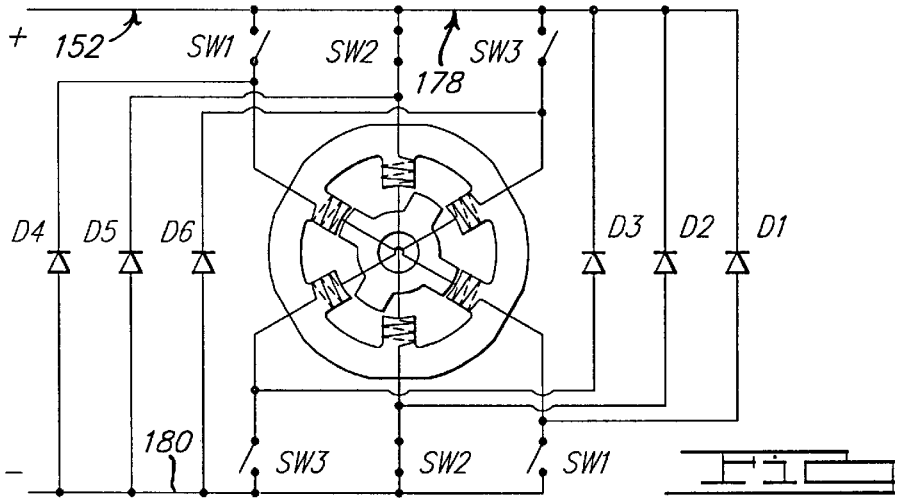
Figure 3C:
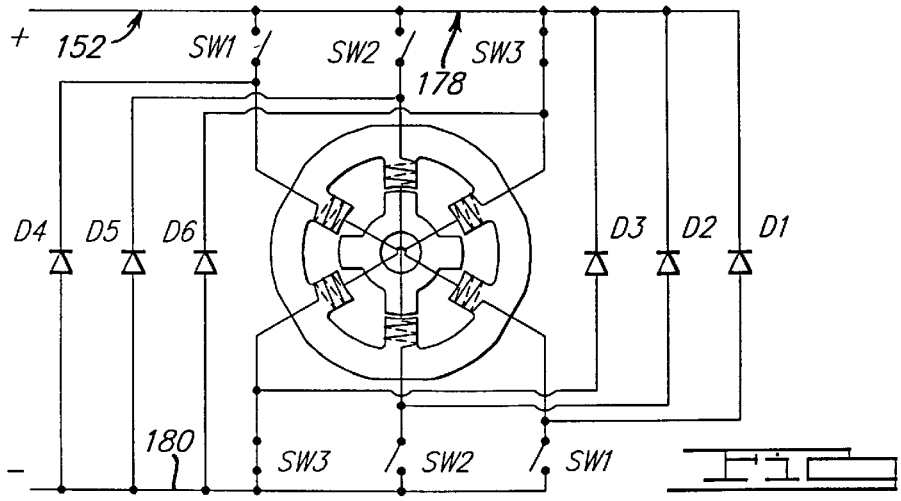

The generation of magnetic forces to cause rotation of rotor 146 is achieved by switching devices that connect and disconnect power supply buss lines 178 and 180 to the individual stator windings 144 so that the current is switched on and off in winding 144 at the appropriate time. As shown in the example of FIGS. 3A through 3C, the switching circuit 152 includes three pairs of switches SW1, SW2, SW3, each pair of switches being connected in series with the stator windings 144 of one pair (directly opposed) of stator poles. Accordingly, phase-1 or motor 140 is controlled via switches SW1, while phase-2 and phase-3 are controlled via respective switches SW2 and SW3. Additionally, each of the stator windings has a pair of free-wheeling diodes for feeding residual magnetic energy back to the power supply buss 178. This residual energy exists in the stator/rotor magnetic circuit under magnetic form when the switch typically needs to be switched off and the magnetic flux is still at a significant level. Therefore, when a pair of switches are turned off, with free-wheeling diodes present, the current can continue to flow in the winding, letting the magnetic flux collapse to zero in the magnetic circuit, and feed back that energy to the power supply. In the event that diodes are not present, a large voltage could develop across the windings, which could damage the switch in an attempt to rid the magnetic circuit of that energy. The free-wheeling diodes therefore accomplish the functions of recovering this energy which can be used by another phase in an efficiency enhancing scheme, and to enhance the reliability of the switches.

The three-phase switching will now be described in connection with the switching circuit 152 in FIGS. 3A through 3C. In FIG. 3A, switches SW1 are closed to turn on phase-1 applying current to the corresponding stator windings 144A. At the same time, switches SW2 and SW3 remain held open, while feedback paths through diodes D6 and D3 allow recovery of the energy that remained in the magnetic circuit 152 in FIG. 3B, switches SW1 open and switches SW2 close. This effectively energizes the stator windings 144B for phase-2, while deenergizing the stator windings 144A of phase-1. As mentioned above, the feedback diodes D4 and D1 feed back energy from the magnetic circuit through windings 144 to the power supply and stator windings 144B.

Finally, in FIG. 3C, switches SW2 are opened and switches SW3 are closed to energize phase-3 and turn-off phase-2, followed by the typical energy feedback through diodes D5 and D2. The sequential switching from phase-1 to phase-2 to phase-3 and back to phase-1 continues in a timely fashion in response to the appropriate position of the rotor 146 for a given load to achieve the desired motor speed.

Figure 4:
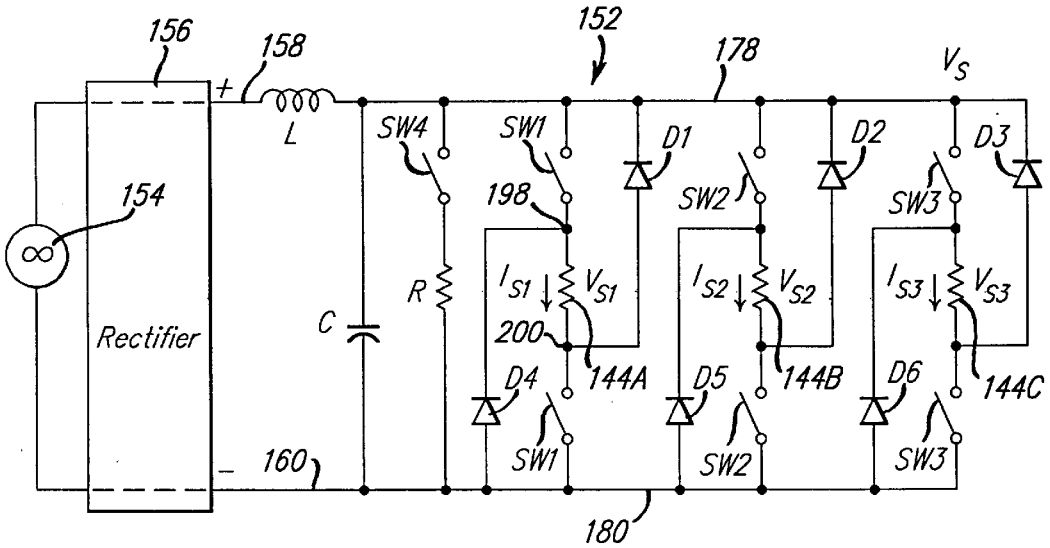
FIG. 4 is a circuit diagram further illustrating motor control switching according to the present invention.

With particular reference to FIG. 4, the motor control switching circuit 152 is further shown connected to an alternation current (AC) power source 154 and a full-wave rectifier 156 for producing a direct current (DC) voltage across lines 158 and 160. An inductor-capacitor (L-C) filter also couples lines 158 and 160 to buss lines 178 and 180, respectively, to smooth the voltage output of rectifier 156. Switching circuit 152 comprises three phase control circuits connected in parallel for controlling the respective phases of the motor 140 as was previously described in connection with FIGS. 3A through 3C. Capacitor C, which is connected in parallel with each of the three phases of the motor, advantageously stores energy as it is either supplied cyclically by the rectifier bridge 156 or from the diode recovery circuits. Additionally, an optional series connected switch SW4 and resistor R may be connected in parallel with the three phases of the motor. Switch SW4 may be closed in a constant or pulse fashion to either discharge circuit 152 at shutdown after the motor is stopped and all energy is bled, or to bleed excessive recovery energy resulting from braking as will be explained later hereinafter.

Figure 5:
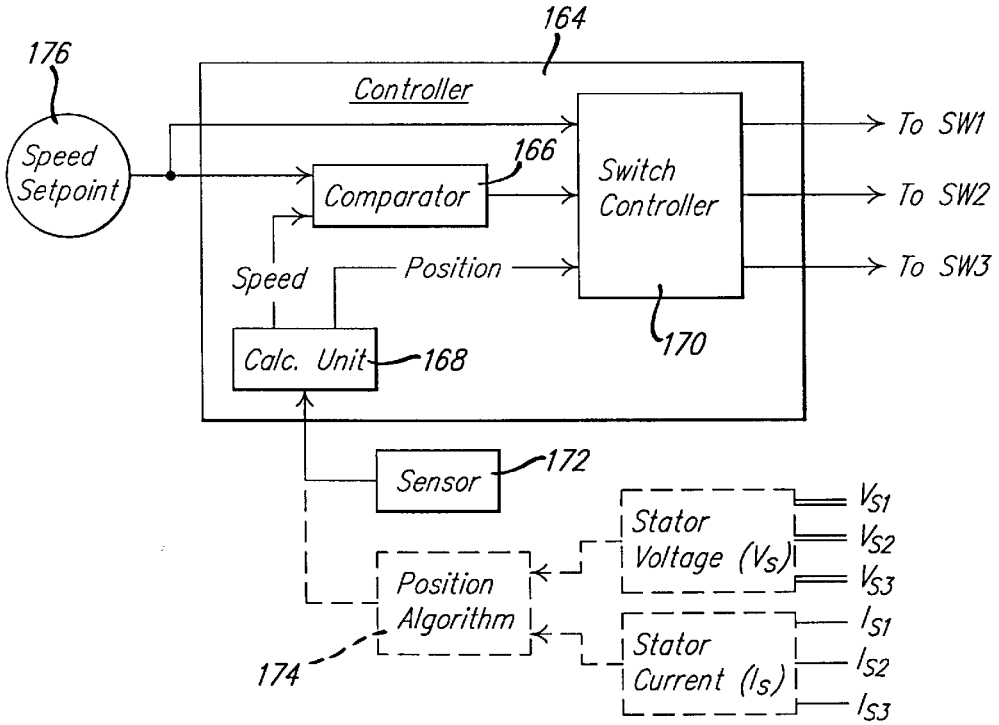
FIG. 5 is a block diagram of a controller for controlling the motor switching in accordance with the present invention.

The on-off switching of switches SW1, SW2 and SW3 are controlled in response to control signals generated by a controller 164 as shown in FIG. 5 following a control strategy shown in table of FIG. 6. With particular reference to FIG. 5, controller 164 includes a comparator 166, a calculating unit 168 and a switch controller 170.

Figure 7:
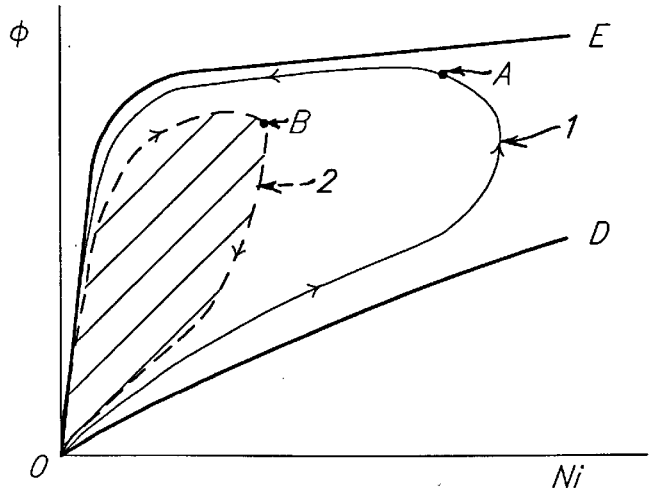
FIG. 7 is a flux, ampere-turn energy diagram illustrating motoring and braking motor control.

Calculating unit 168 is configured to receive a position signal from either a conventional position sensor or sensors 172, or a position estimating algorithm 174. Position sensor 172 may comprise a Hall effect magnetic sensor or sensors for sensing position of the crankshaft 30 or rotor 146. Optionally, position estimating algorithm 174 would sense the stator voltage ($V_{S1}$, $V_{S2}$, or $V_{S3}$) applied across each of the stator windings 144 at nodes 198 and 200, for example, and also senses the stator current ($I_{S1}$, $I_{S2}$, or $I_{S3}$) flowing through at least one of the stator windings 144. In response thereto, position algorithm 174 would then determine the current position of the crankshaft 30 or rotor 146 as a function of sensed stator voltage and current. This is possible since, as seen in FIG. 7, there is a unique flux current position relationship, and magnetic flux Φ can be inferred through integration of:

$$\frac{d\phi}{dt}$$

which is known when the winding turns N, winding resistance R, voltage V and current i are known because, $$\frac{d\phi}{dt} = \frac{V - Ri}{N}$$

Calculating unit 168 determines the angular speed rotation of crankshaft 30 as a function of the received rotor position signals over time. Comparator 166 compares the calculated speed to a speed setpoint 176, established by the usual overall refrigerating of HVAC system demand circuit. The output of comparator 166, as well as speed setpoint 176 and position signal are applied to switch controller 170. With speed setpoint 176, comparator output and position signal, switch controller 170 determine a control decision for controlling the pairs of switches SW1 through SW3 as illustrated in FIG. 6.

With a speed setpoint greater than zero, indicative of a desired forward speed of the motor 140, and a forward speed signal less that the speed setpoint, controller 164 will generate an increase-speed signal to adjust the on and off timing of switches SW1 through SW3 so as to increase the amount of energy input to the windings to increase the speed of the motor 140. If the speed signal is greater that the speed setpoint, controller 164 will generate a decrease-speed signal which will adjust the on and off timing of switches SW1 through SW3 to decrease the energy input to the windings to decrease the speed of motor 140. If the speed is equal to the desired setpoint, no speed change will be effected.

In the event the load has changed, thus reducing the speed of the motor, the controller 164 will be required to attempt to maintain the speed through the generation of an increase speed signal by adjusting the timing of the switches with regard to the position of the rotor 146. However, if the load is increased in such a manner that the maximum allowable input to the motor is reached by reaching the limits at which the timing can be set for the switches to obtain the maximum output of the motor, then a preset "no speed change " signal can override the input to the switch controller. Also, a situation resulting from a malfunction in any components and causing the speed to exceed any preset upper limit can be made to override the input in a similar fashion (as above), thus providing a rotation speed limiting scheme.

When the speed setpoint is set equal to zero, indicative of the operation of turning motor 140 off to therefore be deenergized, and there is still forward rotation of the motor as it coasts down in speed, controller 164 generates a signal to hold switches SW1 through SW3 open. When the crankshaft 30 reaches a speed of zero, indicative of the motor being stopped, controller 164 likewise generates a signal to maintain switches SW1 through SW3 open. It should be understood that with the existence of a large pressure differential between the outlet and inlet of the compressor, high pressure discharge gaseous fluid will exert a force which will cause the crankshaft 30 and rotor 146 connected thereto to quickly decrease in forward speed and then quickly increase in speed in the reverse direction of rotation. According to a preferred embodiment, when reverse rotation is detected by a negative speed signal, the controller 164 generates a braking signal to apply a braking torque to the rotor 146 so as to oppose reverse rotation. In response to a braking signal, switch controller 170 will adjust the one and off timing of switches SW1 through SW3 so as to produce a braking torque which attempts to drive rotor 146 back toward the forward direction of rotation, thereby reducing the reverse rotation speed. This allows the compressor 10 to equalize the pressure difference between the inlet and outlet through normal leakage as a result of the reduced speed of reverse rotation. This advantageously reduces the adverse effects otherwise caused by sudden high speed reverse rotation of the compressor components.

FIG. 7 represents the functional operation of the magnetic circuit for one phase in terms of magnetic flux as a function of the Ampere-turns (Ni) applied. Lines D and E represent the magnetization (saturation) curves of the circuit in the disengaged and engaged positions, respectively. The area represents energy as is well known in the electrical art, $dW=Ni(d\phi)$. Thus, the integral $Nid(\phi)$ or the area enclosed in loop (1) represents the energy spent in the circuit and transformed in mechanical energy in the forward direction. It can be seen that the flux builds up when the switches close when the rotor pole is mostly disengaged, and the switches are opened at point A when the rotor is mostly engaged flowing the direction of the arrow.

The motor control switching circuit 152 of the present invention can advantageously be used efficiently at any given speed for driving the motor in a forward direction and also for generating the brake torque to oppose reverse rotation. This is accomplished through the appropriate timing of the switches, which can switch and allow for the magnetization of the stator/rotor circuit when the rotor pole is well engaged within the stator pole as seen in loop (2) of FIG. 7 from points 0 to B and the demagnetization (switch off) when the rotor pole is disengaging from points B to 0. During the collapse of the magnetic flux, the mechanical energy from the rotor is transformed into electrical energy (hatched area) recovered by the diode recovery circuit which can be stored in capacitor C and/or used in the other phases and/or wasted into heat in the resistor R through pulsing of switch SW4, if necessary. The fact that the braking results in excess electrical energy can be advantageous. The motor control switching circuit 152 may operate with the AC source 154 turned either on or off. With the AC source 154 turned off, capacitor C, along with inductor L and stator windings 144A through 144C contain energy stored therein which allows the control circuit 152 to produce the braking torque.

While this invention has been described in connection with a particular example, no limitation is intended except as defined by the following claims. Skilled practitioner will realize that other modification can be made without departing from the spirit of this invention after studying the specification and drawings.

What is claimed is:

1. A rotary compressor comprising:

a compression chamber;

a drive shaft for forcibly causing compression within the compression chamber;

a switched reluctance type motor having a rotor coupled to the drive shaft, the rotor including one or more pairs of rotor poles, the motor further including a stator having one or more pairs of stator poles for providing a reluctance torque to rotate the rotor in a forward direction;

a controller for determining if a change in condition has occurred which could result in reverse rotation of the rotor;

a switching circuit for energizing the pairs of stator poles in response to said controller determining the occurrence of a change in condition so as to apply a braking torque to the rotor to oppose reverse rotation; and a feedback circuit for feeding back energy induced during reverse rotation of the shaft into the stator as a result of said switching circuit switching energy to the stator to allow for magnetization of the stator and rotor as a pair of rotor poles is engaged within a pair of stator poles and demagnetization when the pair of rotor poles is disengaged from the pair of stator poles.

2. The compressor as defined in claim 1 wherein said compressor comprises a scroll type compressor.

3. The compressor as defined in claim 1 wherein said rotor has one or more salient members, each salient member forming a rotor pole.

4. The compressor as defined in claim 1 wherein the change in condition is a reversal in the direction of rotation of said rotor.

5. The compressor as defined in claim 1 wherein the controller determines said change in condition as a function of voltage and current applied to said stator without the need for a position sensor.

6. The compressor as defined in claim 1 wherein the controller is coupled to a position sensor for receiving a signal indicative of the current position of the rotor.

7. The compressor as defined in claim 1 further comprising a source supplying power to said stator.

8. The compressor as defined in claim 1 further comprising:

a capacitor coupled in parallel with said stator for storing energy; and a discharge path including a switch coupled to a resistor, wherein said switch may be closed in a pulsed fashion to bleed excess energy in the stator and the capacitor.

9. The compressor as defined in claim 1 wherein said compressor may undergo reverse rotation upon deenergization after a delay period.

10. The compressor as defined in claim 1 wherein said switching circuit sequentially applies current to said pairs of stator poles when operating the rotor in the forward direction.

11. The compressor as defined in claim 1 wherein said controller determines a speed signal and compares the speed signal with a setpoint value, said controller further including a switch controller for controlling the switching circuit, said switch controller receiving the setpoint value, a position signal which identifies the position of the rotor, and a comparator signal which compares the speed signal with the setpoint value.

12. The compressor as defined in claim 1 wherein said controller operates a plurality of switches in said switching circuit to increase and decrease torque produced by the motor as a function of on and off switch timing of the switches.

13. A rotary compressor comprising:

a pumping chamber, a driving shaft for forcibly causing compression within the pumping chamber;

a motor having a non-permanent magnetic rotor coupled to the drive shaft, the rotor including one or more pairs of rotor poles, said motor further including a stator having one or more pairs of electrical stator circuits for applying a torque to rotate the rotor in a forward direction;

a controller for determining if a change in condition has occurred which could result in reverse rotation of the motor;

a switching circuit for applying current to the stator circuits in response to said controller determining the occurrence of a change in condition so as to oppose reverse rotation of the rotor;

a recovery circuit for feeding back energy into the stator circuits and into a storage circuit, said recovery circuit operable to recover residual energy during forward rotation of the rotor and operable to recover induced energy during reverse rotation of the rotor as a result of said switching circuit switching energy to the stator circuits to allow for magnetization of the stator and rotor as a pair of rotor poles is engaged within a pair of stator poles and demagnetization when the pair of rotor poles is disengaged from the pair of stator poles; and a discharge path including a switch coupled to a resistor, wherein said switch may be closed in a pulsed fashion to bleed excess energy in the stator circuits and the storage circuit.

14. A rotary compressor comprising:

a compression chamber;

a driving shaft for forcibly causing compression within the compression chamber;

a reluctance type motor having a rotor containing one or more salient members forming one or more pairs of rotor poles, the motor further including a stator having one or more pairs of electrical stator circuits for applying a torque to the rotor to rotate the rotor in a forward direction;

a controller for determining if a change in condition has occurred which could result in reverse rotation of the motor;

a feedback circuit for feeding back energy into the stator circuits; and a switching circuit having a plurality of switches for applying current to the stator circuits in response to said controller determining the occurrence of a change in condition so as to apply a braking torque to the rotor to oppose reverse rotation of the rotor as a function of on and off switch timing, whereby said feedback circuit is operable to feedback to the stator circuits current induced during reverse rotation of the rotor based upon the one and off switching time as a result of said switching circuit switching energy to the stator circuits to allow for magnetization of the stator and rotor as a pair of rotor poles is engaged within a pair of stator poles and demagnetization when the pair of rotor poles is disengaged from the pair of stator poles.

15. A method of controlling a rotary compressor to oppose reverse rotation of a motor during a compressor shutdown, said method comprising the steps of:

applying energy to a stator having one or more stator pairs to drive a rotor having one or more rotor poles in a forward direction;

reducing the applied energy to turn off the compressor motor;

determining if a change in condition has occurred which could result in reverse rotation of the rotor;

re-applying energy to the stator to oppose reverse rotation of the rotor;

recovering energy induced in the stator circuits during reverse rotation of the rotor by allowing for magnetization of the stator and rotor as a pair of rotor poles is engaged within a pair of stator poles and demagnetization when the pair of rotor poles is disengaged from the pair of stator poles; and feeding the recovered energy back to the stator circuits to assist in applying a braking torque to the rotor to oppose the reverse rotation of the rotor without the need for an external power supply source.

16. A method of controlling a rotary compressor to oppose reverse rotation of the motor during a compressor shutdown, said method comprising the steps of:

applying energy to drive circuits of a stator having a plurality of stator poles to drive a rotor having a plurality of rotor poles as a function of reluctance so as to drive the rotor in a forward direction;

reducing the applied energy to turn off the compressor motor;

determining if a change in condition has occurred which could result in reverse rotation of the rotor in response to a current position of the rotor as a function of sensed stator voltage and current; and reapplying energy from a feedback circuit and a storage circuit to the drive circuits of the stator to oppose reverse rotation of the rotor by allowing for magnetization of the stator and rotor as a pair of rotor poles is engaged within a pair of stator poles and demagnetization when the pair of rotor poles is disengaged from the pair of stator poles such that mechanical energy from the rotor is transferred into electrical energy received by the feedback circuit and the storage circuit, thereby enabling the drive circuit to produce a braking torque without the need for external power supply source.

17. A scroll compressor comprising:

a pair of interleaved scroll members;

a rotating shaft for driving said scroll members so that they orbit relative to one another, said relative orbital movement causing at least one compression chamber to be formed which becomes progressively smaller as it moves from an inlet zone at inlet gas pressure to a discharge zone at discharge gas pressure;

a reluctance type electric motor for rotating said shaft, said motor including a rotor having one or more pairs of rotor poles and a stator having one or more pairs of stator poles;

a discharge gas plenum in communication with said discharge zone for receiving discharge gas therefrom, the difference between said discharge pressure and said inlet pressure and the volume of said discharge plenum being sufficiently large that pressurized gas in said discharge plenum will drive the compressor backwards in the absence of a braking force;

a controller for determining if the rotor is in reverse rotation;

a switching circuit for applying energy to said stator poles to apply a reluctance induced torque to the rotor of the motor to oppose reverse rotation of the shaft; and a feedback circuit for feedingback energy induced during reverse rotation of the shaft into the stator by allowing for magnetization of the stator and rotor as a pair of rotor poles is engaged within a pair of stator poles and demagnetization when the pair of rotor poles id disengaged from the pair of stator poles such that mechanical energy from the rotor is transferred into electrical energy received by the feedback circuit, thereby assisting the switching circuit to produce a braking torque.

18. A scroll compressor comprising:

a pair of interleaved scroll members;

a rotating shaft for driving said scroll members so that they orbit relative to one another, said relative orbital movement causing a plurality of compression chambers to be formed which becomes progressively smaller as they move from a inlet zone at inlet gas pressure to a discharge zone at discharge gas pressure, the difference between said discharge pressure and said inlet pressure and the volume of said compression chambers being sufficiently large that pressurized gas in said compression chambers will drive the compressor backwards in the absence of a braking force;

a switched reluctance type electric motor for rotating said shaft, said motor including a rotor having one or more pairs of rotor poles and stator having one or more pairs of stator poles;

position means for determining the position of the rotor as a function of voltage and current applied to the stator;

controller for determining if the rotor is in reverse rotation whereby the controller determines the change in position in response to a position signal from the position means;

a switching circuit for applying energy to said stator poles to apply a reluctance induced torque to the rotor of the motor to opposed reverse rotation of the shaft; and a feedback circuit for feeding back energy induced during reverse rotation of the shaft into the stator as a result of said switching circuit switching energy to the stator to allow for magnetization of the stator and rotor as a pair of rotor poles is engaged within a pair of stator poles and demagnetization when the pair of rotor poles is disengaged from the pair of stator poles.

19. A rotary compressor comprising:

a compression chamber;

a drive shaft for forcibly causing compression within the compression chamber;

a electric motor having a rotor coupled to the drive shaft, the rotor including a plurality of rotor poles, the motor further including a stator having a plurality of stator poles for providing a torque to rotate the rotor in a forward direction;

a controller for determining if a change in condition has occurred which could result in reverse rotation of the rotor, said controller determining the change in condition in response to the position of the rotor as a function of sensed stator voltage and current without the need for a position sensor;

a switching circuit for energizing said stator poles in response to said controller determining the occurrence of a change in condition so as to apply a braking torque to the rotor to oppose reverse rotation; and a feedback circuit for feeding back energy into the stator induced during reverse rotation of the rotor as a result of said switching circuit switching energy to the stator circuits to allow for magnetization of the stator and rotor as a pair of rotor poles is engaged within a pair of stator poles and demagnetization when the pair of rotor poles is disengaged from the pair of stator poles such that mechanical energy from the rotor is transferred into electrical energy received by the feedback circuit, thereby enabling the switching circuit to produce a braking torque without the need for an external power supply source.

20. The compressor as defined in claim 19 wherein said feedback circuit includes a diode in each feedback path.

21. The compressor as defined in claim 19 wherein the switching circuit sequentially applies current to the plurality of stator poles when operating the rotor in the forward direction.

22. The compressor as defined in claim 19 further comprising passive circuitry for storing energy which may be applied to the stator to apply said braking torque.

23. The compressor as defined in claim 22 wherein said passive circuitry comprises a capacitor.

24. The compressor as defined in claim 22 wherein said passive circuitry comprises an inductor.

25. The compressor as defined in claim 19 further comprising a discharge path including a switch coupled to a resistor for discharging energy within said stator when closed.

26. A rotary compressor comprising:

a compression chamber;

a drive shaft for forcibly causing compression within the compression chamber;

an electric motor having a rotor coupled to the drive shaft, the rotor including a plurality of rotor poles, the motor further including a stator having a plurality of stator poles for providing a torque to rotate the rotor in a forward direction;

a controller for determining if a change in condition has occurred which could result in reverse rotation of the rotor;

a switching circuit having a plurality of switches for energizing said plurality of stator poles in response to said controller determining the occurrence of a change in condition so as to apply a braking torque to the rotor to oppose reverse rotation;

a feedback circuit for feeding back to the stator and a storage circuit current induced during reverse rotation of the rotor as a result of said switching circuit switching energy to the stator poles to allow for magnetization of the stator and rotor as a pair of rotor poles is engaged within a pair of stator poles and demagnetization when the pair of rotor poles is disengaged from the pair of stator poles such that mechanical energy from the rotor is transferred into electrical energy received by the feedback circuit and the storage circuit, thereby assisting the switching circuit to produce a braking torque; and a discharge path including a switch coupled to a resistor, wherein said switch may be closed in a pulsed fashion to bleed excess energy in the stator and the storage circuit.

27. The compressor as defined in claim 26 wherein said feedback circuit includes a diode in each feedback path.

28. The compressor as defined in claim 26 further comprising passive circuitry for storing energy which may be applied to the stator to apply said braking torque.

29. A rotary compressor which opposed reverse rotation of a motor during a compressor shutdown and does not require any position sensors for detecting reverse rotation of the motor, said compressor comprising:

a compression chamber;

a drive shaft for forcibly causing compression within the compression chamber;

a motor having a rotor coupled to the drive shaft, the rotor including a plurality of rotor poles, the motor further including a stator having a plurality of stator poles for providing a reluctance torque to rotate the rotor in a forward direction;

a controller for determining if a change in condition has occurred which could result in reverse rotation of the rotor, said change in condition being determined from sensed stator voltage and current without requiring position sensors;

a switching circuit for energizing a motor stator circuit in response to said controller determining the occurrence of a change in condition so as to apply a braking torque to oppose reverse rotation; and a feedback circuit for feeding back energy induced during reverse rotation of the shaft into the stator as a result of said switching circuit switching energy to the stator to allow for magnetization of the stator and rotor as a pair of rotor poles is engaged within a pair of stator poles and demagnetization when the pair of rotor poles is disengaged from the pair of stator poles such that mechanical energy from the rotor is transferred into electrical energy received by the feedback circuit, thereby enabling the switching circuit to produce a braking torque.

* * * * *

UNITED STATES PATENT AND TRADEMARK OFFICE

CERTIFICATE OF CORRECTION

PATENT NO. : 5,820,349

DATED : October 13, 1998

INVENTOR(S) : Jean-Luc Caillat

It is certified that error appears in the above-indentified patent and that said Letters Patent is hereby corrected as shown below:

On the Title Page, in the title, line 2, "ROTATING" should be -- ROTATION --.

Column 1, line 2, "ROTATING" should be -- ROTATION --.

Column 1, line 31, "there" (first occurrence) should be -- these --.

Column 3, line 2, "4,988,864" should be -- 4,998,864 --.

Column 3, line 15, after "poles" insert -- . The stator poles --.

Column 3, line 33, "winding" should be -- windings --.

Column 3, line 38, "or" should be -- of --.

Column 3, line 64, after "circuit" insert -- excited by phase-3 which just previously turned off. Referring to the switching circuit --.

Column 4, line 13, "alternation" should be -- alternating --.

Column 4, line 65, after "speed" insert -- of --.

Column 5, line 2, "of" should be -- or --.

Column 5, line 6, "determine" should be -- determines --.

Column 5, line 53, "one" should be -- on --.

UNITED STATES PATENT AND TRADEMARK OFFICE

CERTIFICATE OF CORRECTION

PATENT NO. : 5,820,349

DATED : October 13, 1998

INVENTOR(S) : Jean-Luc Caillat

It is certified that error appears in the above-indentified patent and that said Letters Patent is hereby corrected as shown below:

Column 6, line 2, after "integral" insert -- of --.

Column 6, line 2, "Nid($\phi$)" should be -- Ni(d$\phi$) --.

Column 6, line 8, "flowing" should be -- following --.

Column 6, line 12, "brake" should be -- braking --.

Column 8, line 28, "one" should be -- on --.

Column 9, line 13, after "for" insert -- an --.

Column 9, line 44, "id" should be -- is --.

Column 9, line 55, "a" should be -- an --.

Column 10, line 1, before "controller" insert -- a --.

Column 10, line 7, "opposed" should be -- oppose --.

UNITED STATES PATENT AND TRADEMARK OFFICE

CERTIFICATE OF CORRECTION

PATENT NO. : 5,820,349

DATED : October 13, 1998

INVENTOR(S) : Jean-Luc Caillat

It is certified that error appears in the above-indentified patent and that said Letters Patent is hereby corrected as shown below:

Column 10, line 19, "a" (first occurrence) should be -- an --.

Column 12, line 1, "opposed" should be -- opposes --.

Signed and Sealed this

Seventeenth Day of August, 1999

*Attest:*

Q. TODD DICKINSON

*Attesting Officer*

*Acting Commissioner of Patents and Trademarks*